United States Patent [19]

DeCloux

[11] Patent Number: 4,986,532

[45] Date of Patent: Jan. 22, 1991

[54] HAND RAIL FOR STAND-UP EXERCISE EQUIPMENT

[76] Inventor: Richard J. DeCloux, 1485 Belmont St., Manchester, N.H. 03104

[21] Appl. No.: 311,068

[22] Filed: Feb. 14, 1988

[51] Int. Cl.[5] ..... A63B 1/00; A63B 23/04

[52] U.S. Cl. ..... 272/70; 272/62; 272/69; 272/143

[58] Field of Search ..... 272/69, 70, 113, 73, 272/134, 70.3, 70.4, 93, 97; 128/25 R; D21/192, 194

[56] References Cited

U.S. PATENT DOCUMENTS

| | | | |
|---|---|---|---|
| D. 282,386 | 1/1986 | Dealey et al. | D21/192 |
| 2,399,915 | 5/1946 | Drake | 128/25 R |
| 2,622,658 | 12/1952 | Morgan | 272/113 X |
| 3,581,739 | 6/1971 | Brandt | 272/134 X |
| 4,708,338 | 11/1987 | Potts | 272/69 X |
| 4,733,858 | 3/1988 | Lan | 272/97 X |

*Primary Examiner*—Richard J. Apley
*Assistant Examiner*—D. F. Crosby
*Attorney, Agent, or Firm*—Robert K. Tendler

[57] ABSTRACT

An arcuate hand rail for exercise equipment accommodates both varying height individuals as well as individuals leaning towards the exercise machine by orienting and positioning the arcuate hand rail such that a vertical tangent thereto lies at or adjacent the average vertical center line of an exercising individual on the exercise apparatus in a stand-up orientation. This placement of the tangent point at or adjacent the average vertical center line of the standing individual permits a wide range of individuals to grasp the hand rail when exercising in a stand-up mode, with elbows bent in a comfort range of 15°-55° to the horizontal while at the same time, as an additional benefit, providing arm-extended grip points for comfortable lean-forward exercise.

5 Claims, 4 Drawing Sheets

HAND RAIL FOR STAND-UP EXERCISE EQUIPMENT

FIELD OF THE INVENTION

This invention relates to stand-up exercise devices such as exercise stairs, tread mills, and exercise bicycles when used in the 'stand-up' mode; and, more particularly, to a hand rail design that provides comfortable 'upright' and 'lean forward' operation for users of different height.

BACKGROUND OF THE INVENTION

Present stand-up exercise equipment provides users with fixed straight-bar or rectilinear hand rails. These hand rails try to accommodate two modes of use; exercise in an upright position similar to that normally used in steady state running, climbing, and stand-up biking; and exercise in a leaning forward position similar to that assumed by an accelerating sprinter. These rectilinear hand rails also attempt to accommodate users with body height differentials of a foot or more.

The rectilinear hand rail accommodates body height differentials most effectively when it is on a slope more vertical than horizontal. However, a slope more horizontal than vertical is required for a rectilinear hand rail to best accommodate both 'upright' and 'lean forward' modes of use. Present stand-up exercise equipment uses rectilinear hand rails with slope selected as a compromise between that slope best suited for accommodating both 'upright' and 'lean' use. As with most compromises, the result is inappropriate exercise positions for taller and shorter users. Inappropriate exercise position usually makes a user feel uncomfortable or look ungainly during exercise. Inappropriate exercise position can lead to strains that cause discomfort which continues after the exercise session is over.

More particularly, when stand-up exercising it is desirable to have the hand rail about waste-high so that for stand up exercise the lower arm makes a 90° angle with the upper arm. This translates into a comfort zone angle of between 15° and 55° the angle being that between the lower arm and the horizontal. For lean over exercise it is generally desired to grasp a rail with arms nearly fully extended. Note that for short individuals, grasping a high rail looks and feels awkward while giving little perceived or real sense of security. For tall persons in a stand-up position, his hands cannot reach the rail unless his arms are almost fully extended. This again gives the feel of instability.

In his text book, "Human Factors in Engineering and Design", Ernest McCormick says that the combinations of variables involved make it almost impossible to design a fixed work-surface for people of all sizes. As a result of the complexity of the design problem, McCormick suggests adjustability as a solution and cites a Western Electric adjustable workstation.

It will be appreciated that adjustable hand rails could bring more comfort to a greater range of users and modes of use. However, adjustability involves user instruction, user time and inconvenience, additional cost, and an added potential for structural failure and possible injury. The negatives associated with adjustable rail systems thus outweigh the benefits. As a result, in order to have both tall and short users comfortable using a fixed hand rail system while exercising in either the 'upright' or 'lean' mode, it is necessary to provide a more accommodating geometry than is presently available.

SUMMARY OF THE INVENTION

In contradistinction to the rectilinear arm rails, it has been found that an arcuate hand rail offers superior accommodation to different size individuals. Moreover, a particular positioning of the arc relative to an individual standing on the exercise machine provides benefits both for stand up exercise and for lean over exercise.

To be more precise, an arcuate hand rail for exercise equipment accommodates both varying height individuals as well as individuals leaning towards the exercise machine by orienting and positioning the arcuate hand rail such that a vertical tangent thereto lies at or adjacent the average vertical center line of an exercising individual on the exercise apparatus in a stand-up orientation. This placement of the tangent point at or adjacent the average vertical center line of the standing individual permits a wide range of individuals to grasp the hand rail when exercising in a stand-up mode, with bent elbows in a comfort range of 15°–55° to the horizontal, while at the same time, as an additional benefit, providing arm-extended grip points for comfortable lean forward exercise. More particularly, this arc hand rail positioning solves the problem of individuals of varying height for stand-up exercise, whereas this same positioning permits a lean-forward exercise through support via that portion of the arc which is more horizontal than vertical. Thus while certain radii are required to accommodate various machines and various size people, without the requisite of the vertical tangent point being at or adjacent the average vertical center line of the exercising individual, no arcuate hand rail regardless of arc radius can provide the range of accommodation for both stand-up or for lean-forward exercise.

If one is to determine the most preferential arc radius and position to handle just the variation in user size, the variation in user size can be described as follows: There is an 11 inch difference between the 5 percentile woman and the 95 percentile man according to the National Health Survey, USPHS. What this means is that there is an 11 inch difference between nearly the smallest female and nearly the tallest male of interest. The average elbow height above the floor of the 5 percentile woman is approximately 35 inches. With the average elbow to grip dimension being 14 inches, the observed general preferred starting grip position is with the forearm 25° below horizontal. This structure places the gripping point of the smallest user, the 5 percentile woman, approximately 25 inches above ground and 5 inches in front of centerline. The 95 percentile male will be gripping under the same stricture at 36 inches above the floor, and approximately 10 inches in front of his centerline. These two points and the points in between are best served by a hand rail in the form of an arc, rather than a straight line. The nominal radius arc to fit would be 16 inches and the center of the arc would be placed 21 inches from the average vertical centerline of the user position on the machine and 25 inches above the average position of the soles of the feet during exercise. Note that the tangent point is advantageously no more than eight inches away from the average vertical centerline in one embodiment.

In accommodating lean forward, 30 degrees of lean at an elbow height of 47 inches for the 95 percentile man would require a forward displacement of approximately 23 inches. If the arc radius were to be between 30 and 35 inches and placed 30 to 35 inches from the user's average vertical centerline and 10 to 15 inches above the average step position, the more vertical section of the arc, that subtended by a 45° angle from the horizontal, would approximate the arc calculated for just user height variations. The more horizontal portion of the arc, that subtended from 45° to 90° from the horizontal, would accommodate the lean forward of both small and large user because there is a large amount of horizontal running hand rail at which to grip with arms extended.

It is thus a feature of this invention that by locating an arcuate rail system adjacent the average vertical centerline of the user, a group of users with significant variation of body height can be provided comfortable stand-up exercise while supported by a fixed rail system. What this does is give a wider range of gripping points on the rail so that while stand-up exercising the individual can grip the rail with elbows cocked at about right angles and with elbows to the side. It is an additional feature of the appropriately located arcuate rail system, that a broad range of user body height can also be accommodated while exercising in the 'lean forward' mode of exercise.

In summary, an arcuate hand rail for exercise equipment accommodates both varying height individuals as well as individuals leaning towards the exercise machine by orienting and positioning the arcuate hand rail such that a vertical tangent thereto lies at or adjacent the vertical center line of a standing individual on the exercise apparatus. This placement of the tangent point at or adjacent the vertical center line of the standing individual permits a wide range of individuals to grasp the hand rail with bent elbows approximately 5 to 10 inches forward of the individual's vertical center line and at a point between 25 and 36 inches above the platform of the individual's feet corresponding to the individual's elbow when at a standing position on the apparatus. The hand rail thus accommodates the distance between the bottom of the foot and the elbow of the individual from 35 inches for a 5 percentile female to 46 inches for a 90 percentile male. This tangent point solves the problem of individuals of varying height for stand-up exercise, whereas this same point permits a lean-forward exercise through support via that portion of the arc which is more horizontal than vertical.

BRIEF DESCRIPTION OF THE DRAWINGS

These and other features of the Subject Invention will be better understood in connection with the Detailed Description taken in conjunction with the Drawings of which.

DETAILED DESCRIPTION

Figure 1:
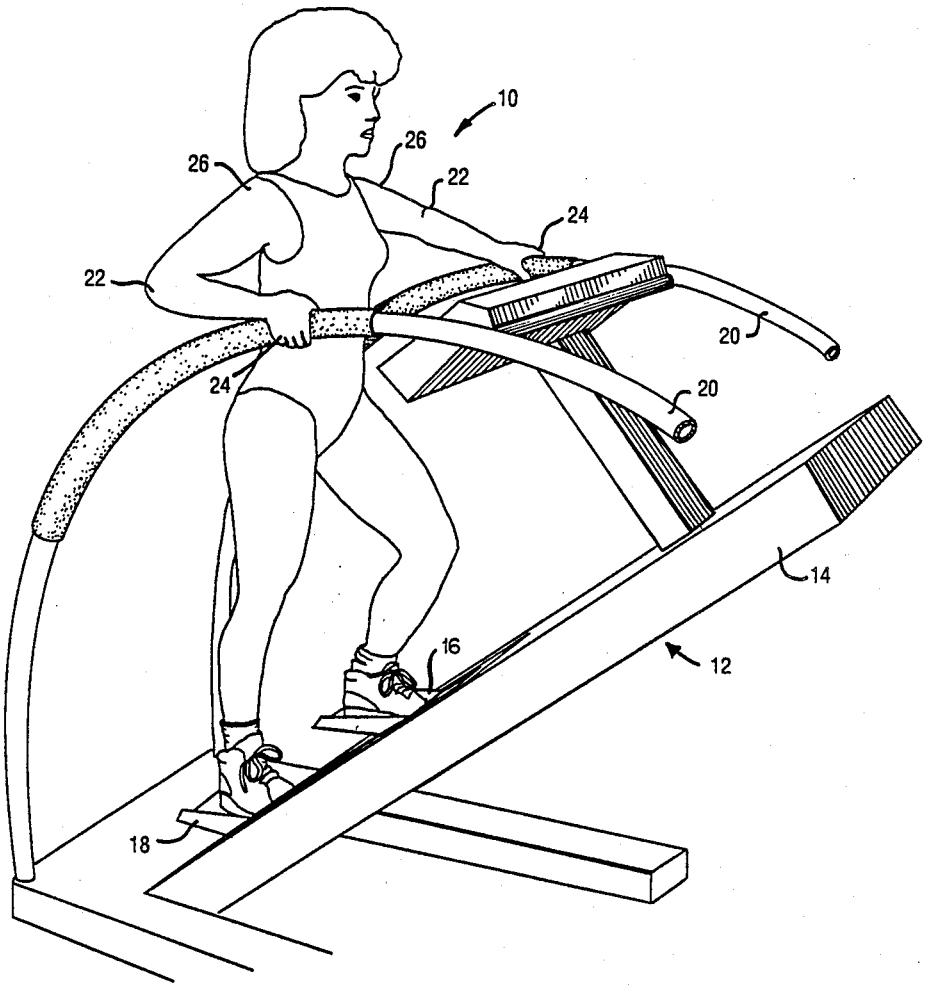
FIG. 1 is a schematic representation of an individual on a prior art exercise machine in which the awkwardness of the arrangement of the hand rails is evident, along with her discomfort.

Referring now to FIG. 1, an individual 10 is illustrated on an exercise machine 12 which in one embodiment includes an apparatus 14 on which are located reciprocating stair steps 16 and 18.

As can be seen the exercise apparatus is provided with an arcuate set of hand rails 20. The hand rails are so located that the individual exercising is uncomfortable because the grip point on the rail is too high, and as a result requires the individual to move the elbows 22 upwardly and outwardly such that the gripping points 24 on the hand rail are close to the shoulders 26. This is an exceedingly uncomfortable position for stand-up exercising as illustrated. The problem, as mentioned hereinbefore, is providing fixed arm rails which will accommodate such a small individual while at the same time accommodating a very large individual. It will be appreciated that, while not shown, if the rail were lowered to accommodate a small individual, a large individual on the same apparatus could have his hands virtually straight down which would provide him no stability in the utilization of the stairclimber exercise machine pictured.

Figure 2:
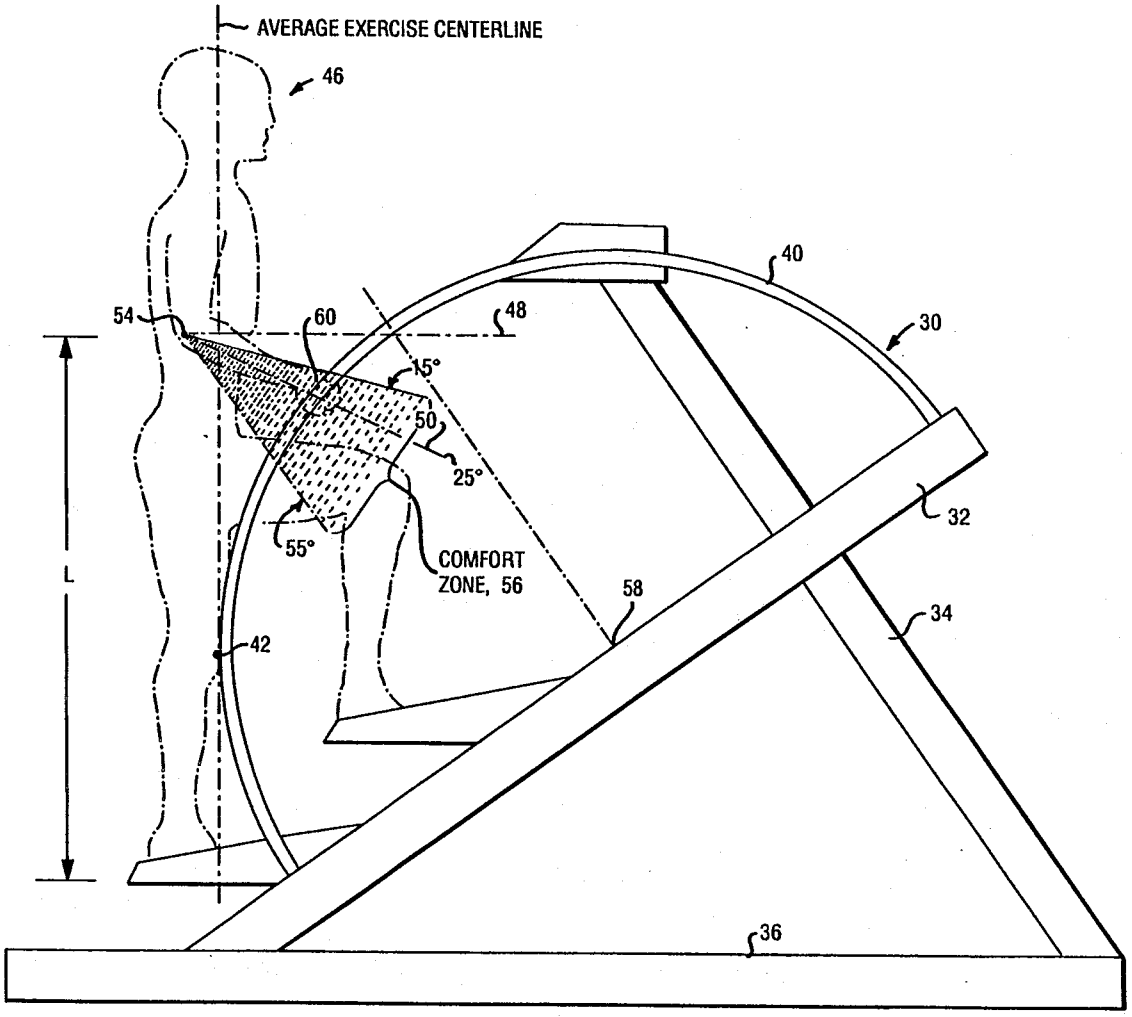
FIG. 2 is a diagrammatic representation, in schematic form, of a relatively large male on the exercise on an incline plane stairclimbing exercise machine illustrating the comfort zone and his position on the device, indicating the vertical tangent point adjacent to the average exercise centerline.

Referring now to FIG. 2, an exercise machine generally indicated by reference character 30 is shown to have an inclined ramp 32 and a support stanchion 34, both positioned on a base 36. In this diagram it will be appreciated that the machine is provided with an arcuate hand rail 40 which has a tangent point 42 in a vertical plane which is at or adjacent to the average exercise centerline 44 of an individual 46. Here it can be seen that the desireable angle of the forearm of individual 46 is at about 25° as indicated by dotted line 50 with respect to a horizontal line 48 running through the elbow joint 54. It has been determined that for most individuals the comfort zone which is the angle between the forearm and the horizontal is preferably between 15° and 55° as illustrated by comfort zone 56. It should be noted that with the arcuate hand rail the more vertical portion of the hand rail which is that portion below a 45° line 57 from the arcuate center here illustrated at 58 permits a wide range of individuals to utilize the hand rail with a hand 60 gripping the corresponding rail at a large plurality of vertical positions near the individual because the arced hand rail has a major vertical component at the position where the individual is to grab the hand rail.

Thus when for instance a 90% male has an elbow to foot distance, L, equal to 47 inches, the subject arched hand rail configured with the tangent point no more than approximately plus or minus 8 inches from his exercise average centerline produces a comfortable point at which he can grab on to the hand rail.

Figure 3:
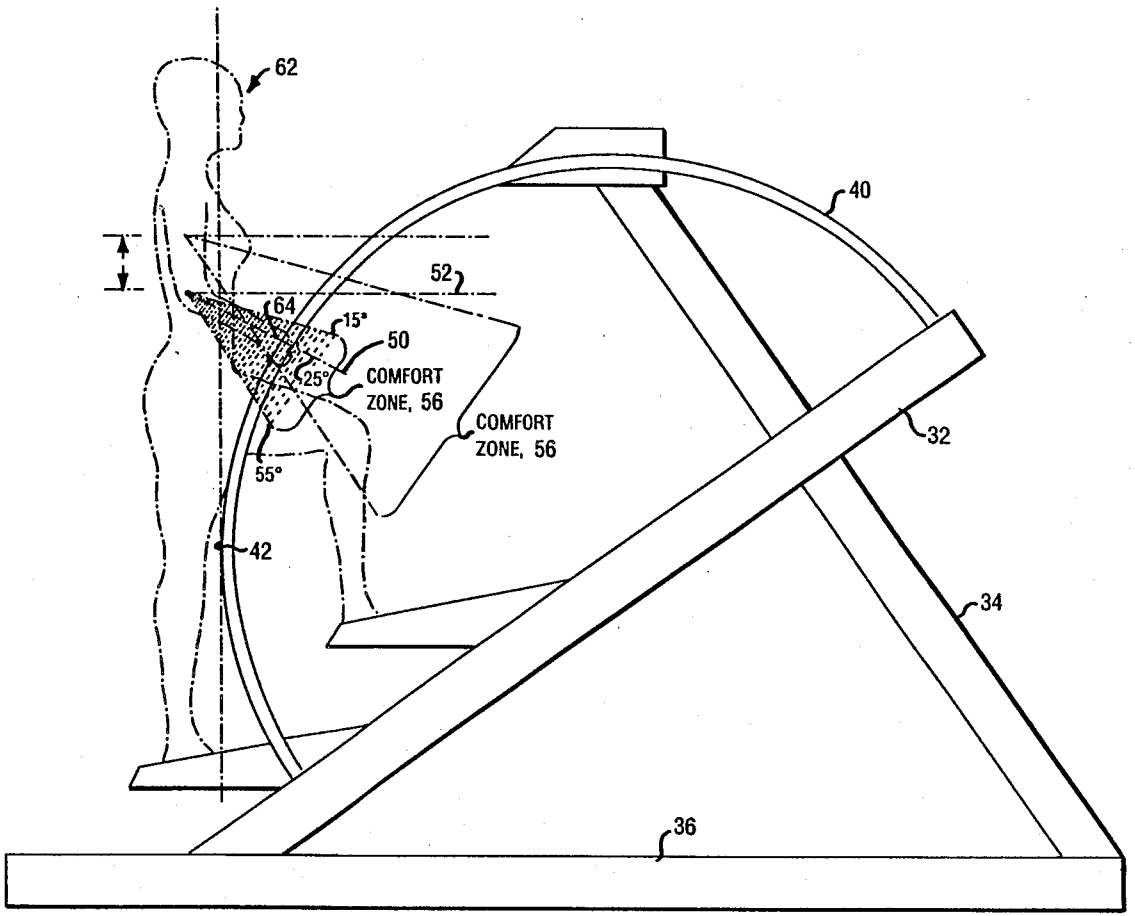
FIG. 3 is a diagrammatic illustration of a small female figure, in schematic form, on the identical machine as pictured in FIG. 2, illustrating the adjacency of the tangent point to the average exercise centerline, also indicating that the comfort zone with respect to this individual overlaps to a large extent the large individual's comfort zone.

Referring to FIG. 3 the identical apparatus is illustrated for a smaller individual here illustrated at 62, which individual corresponds to the 5% female mentioned hereinabove. Here her hand comfortably grips arch rail 40 within her comfort zone 56' due again to the close positioning of the vertical tangent point 42 with respect to her average exercise centerline 44. Note that her comfort zone is mostly within comfort zone 56 for the 90% male, despite the difference, x, between her shoulder and the shoulder of the individual of FIG. 2. Thus the same fixed hand rail can accommodate the largest and smallest individual.

Because of the plurality of the vertically adjacent gripping points on the arcuate rail the comfort of the individual of FIG. 3 is assured with her forearm 64 again residing along a 25° line 50; although as can be seen, her gripping position is below that of the individual of FIG. 2.

What will be appreciated is that for stand-up exercise an arcuate hand rail system can be provided which accommodates, at least in a stand-up position, a large number of users due to the rapidly rising vertical dimension of the hand rail at the average exercise centerline.

Figure 4:
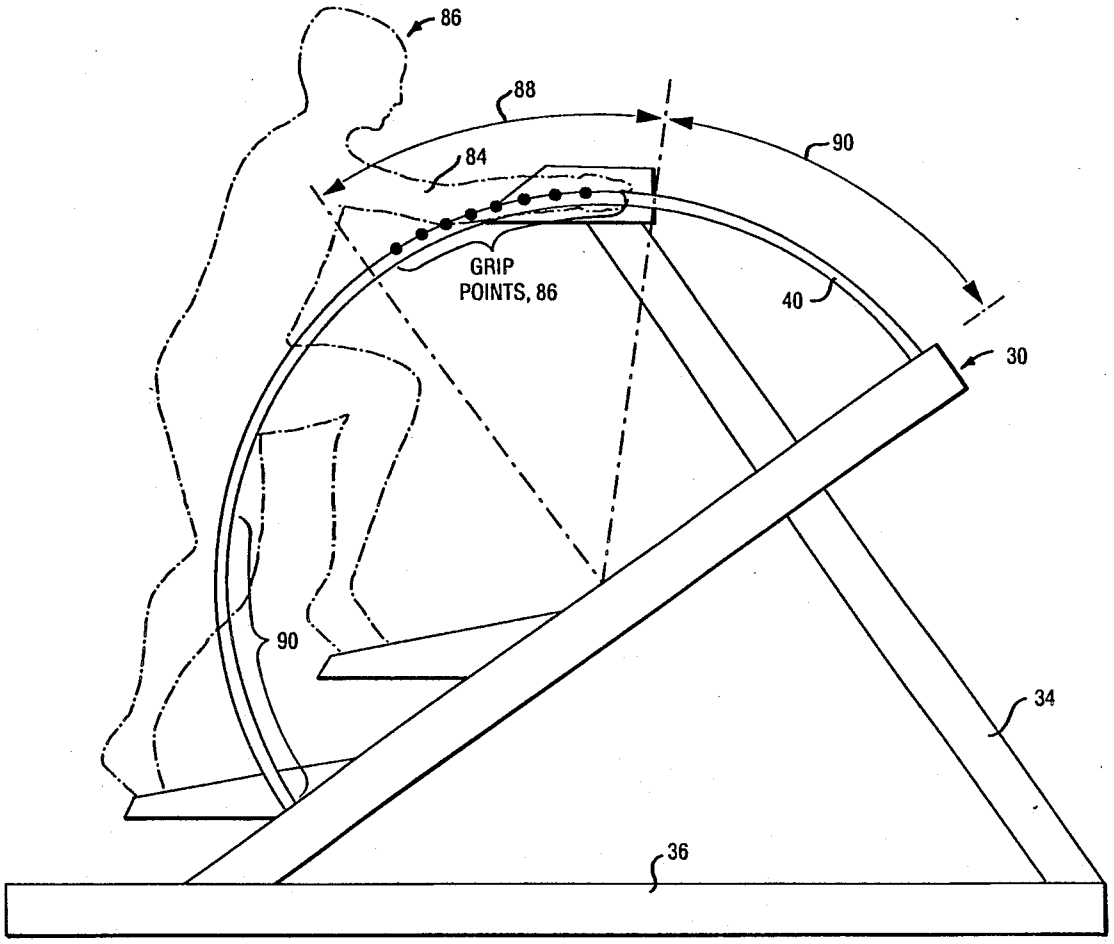
FIG. 4 is a diagrammatic illustration in schematic form, of the individual of FIG. 2 in a lean over as opposed to a stand-up exercise position, indicating the various points on the hand rail which are at his disposal so that his arm can be comfortably extended.

Referring now to FIG. 4 an individual 80 is shown on a like exercise apparatus 30 in a lean-forward exercise position. As can be seen his arms 84 are more extended and are permitted to give a plurality of gripping points 86 along the horizontally extending sector 88 of the arc as indicated as being above the 45° line. What will be appreciated is that due to the arcuate nature of the hand rail, not only will the location of the vertical tangent point at or adjacent the exercise centerline accomplish comfort for the stand-up exercise mode, for the lean-forward exercise mode there will be sufficient horizontally running portions of the arc that the exerciser in his lean over mode can conveniently position himself with his arms extended and his hands grabbing the uppermost portion of the arc.

When applying this invention to specific applications it is important to consider the mode of exercise and its impact on the 'users average centerline' and the degree of 'lean forward'. In the application to treadmills there is a finite 'user average centerline', however the range of movement around it is in some cases up to 18 inches or more. There is very little lean forward to accommodate except in special purpose treadmills. Inclined plane stairclimbers and short armed rotary arm stairclimbers have a range of user average centerline under 12 inches, and both stand-up exercise bikes and long arm rotary arm stairclimbers have at most a few inches of deviation of user average centerline during exercise. The stairclimbers all have a greater lean forward range, up to 30°, than the treadmills or bikes. For larger lean forward accommodation larger arc radii are necessary, e.g., 25 to 40 inches, and for arcs accommodating small amounts of lean forward, smaller arcs can be used, down to a practical minimum of about 16 inches. Vertical placement of the arc depends upon the range of vertical movement which differs again from one mode of exercise to another. It is to be noted that a complex design job becomes relatively simple when the design starts with the placement of the arc tangent as taught herein.

It is helpful to note that in particular applications of this general format for developing effective stand-up exercise equipment rail systems, the arcuate form can be approximated by particular cases of other geometries such as parabolas.

It will also be appreciated that non-gripped arcuate sections 90, can be replaced by other geometry rail sections or by non-rail components. However, the tangent point of the arc of the gripping sections determines the placement of the rail in relation to the user average centerline 44 even if there is no rail section where the tangent point is determined to be.

Having above indicated a preferred embodiment of the present invention, it will occur to those skilled in the art that modifications and alternatives can be practiced within the spirit of the invention. It is accordingly intended to define the scope of the invention only as indicated in the following claims:

What is claimed is:

1. Stand-up aerobic exercise equipment to permit comfortable, stable exercise when an individual is using said equipment, comprising:

a stand-up exercise device having a frame and moveable foot engaging means such that when an individual mounts said device facing in a given direction and when an individual's feet engage said foot engaging means, the individual's body when erect defines an average exercise centerline centered on said foot engaging means when said individual is in position thereon, a handrail having as a major portion a bendless arc; and, means for both anchoring at least one end of said handrail to said frame behind said individual when in position on said foot engaging means, and for locating said bendless arc at said device so that a tangent to said bendless arc is parallel to said individual's average upright exercise centerline when said individual is using said device, said tangent being within eight inches of said average upright exercise centerline.

2. Stand-up aerobic exercise equipment comprising:

a stand-up aerobic exercise device having a frame and moveable foot engaging means such that when an individual mounts said device facing a given direction and when an individual's feet engage said foot engaging means, the individual's body when erect defines an average exercise centerline centered on said foot engaging means when said individual is in position thereon;

a pair of handrails having arcuate bendless handrail portions at said device, one handrail positioned at each side of said device, said equipment having an exercise station adapted to receive an individual, said station having foot receiving means having a range of movement along a horizontal direction, the center of said range of movement defining the user's average upright exercise centerline therebetween; and, means for both anchoring at least one end of each hand rail to said frame behind said individual when in position on said foot engaging means and for locating said handrails such that a vertical tangent to each handrail is at or adjacent the user's upright exercise centerline.

3. The hand rail of claim 2 wherein said exercise machine is a bicycle type exercise machine.

4. The hand rail of claim 2 wherein said exercise machine is a treadmill type exercise machine.

5. The hand rail of claim 2 wherein said tangency point is no more than 8 inches from said centerline.

* * * * *